US009022378B2

(12) United States Patent
Kakuta et al.

(10) Patent No.: US 9,022,378 B2
(45) Date of Patent: May 5, 2015

(54) SHEET CONVEYANCE DEVICE, DOCUMENT CONVEYANCE DEVICE, AND IMAGE FORMING APPARATUS

(71) Applicant: KYOCERA Document Solutions Inc., Osaka-shi, Osaka (JP)

(72) Inventors: Masayuki Kakuta, Osaka (JP); Yuki Tojo, Osaka (JP); Takuro Murata, Osaka (JP); Shinji Akamatsu, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/160,474

(22) Filed: Jan. 21, 2014

(65) Prior Publication Data

US 2014/0210152 A1 Jul. 31, 2014

(30) Foreign Application Priority Data

Jan. 25, 2013 (JP) ..... 2013-012192

(51) Int. Cl.

| | |
|---|---|
| ***B65H 7/04*** | (2006.01) |
| ***B65H 7/02*** | (2006.01) |
| ***B65H 3/34*** | (2006.01) |
| ***B65H 7/20*** | (2006.01) |
| ***B65H 7/18*** | (2006.01) |
| ***B65H 3/46*** | (2006.01) |

(52) U.S. Cl.

CPC .. *B65H 7/04* (2013.01); *B65H 7/20* (2013.01); *B65H 3/34* (2013.01); *B65H 7/18* (2013.01); *B65H 3/46* (2013.01)

(58) Field of Classification Search

CPC ..... B65H 3/0607; B65H 3/46; B65H 7/04; B65H 3/34; B65H 7/02; B65H 7/18

USPC ..... 271/10.02, 259, 10.03, 265.02

See application file for complete search history.

(56) References Cited

U.S. PATENT DOCUMENTS

| | | | | |
|---|---|---|---|---|
| 4,436,298 | A * | 3/1984 | Donner et al. | 271/10.12 |
| 7,584,954 | B2 * | 9/2009 | Nagao | 271/122 |
| 7,887,043 | B2 * | 2/2011 | Takamori et al. | 271/121 |
| 8,695,963 | B2 * | 4/2014 | Taniguchi | 271/110 |
| 2010/0187753 | A1 * | 7/2010 | Suzuki | 271/265.02 |
| 2013/0264765 | A1 * | 10/2013 | Mitsuya et al. | 271/10.02 |

FOREIGN PATENT DOCUMENTS

JP 2000296926 A 10/2000

* cited by examiner

*Primary Examiner* — Patrick Cicchino

(74) *Attorney, Agent, or Firm* — Alleman Hall McCoy Russell & Tuttle LLP

(57) ABSTRACT

In a sheet conveyance device, if a sheet has not been detected at a second position when a predetermined time has elapsed since the sheet has been detected at a first position, a separating portion switches operation thereof from a separating operation to a non-separating operation of conveying the sheet from upstream to downstream in a sheet conveyance path, and a sheet feed portion continues a feeding operation. If the sheet has not been detected at the second position by the time a predetermined time has elapsed since the separating portion has started the non-separating operation, the separating portion and the sheet feed portion stop driving, and if the sheet has been detected at the second position by the time, the separating portion switches operation thereof from the non-separating operation to the separating operation, and the sheet feed portion continues the feeding operation.

16 Claims, 17 Drawing Sheets

SHEET CONVEYANCE DEVICE, DOCUMENT CONVEYANCE DEVICE, AND IMAGE FORMING APPARATUS

INCORPORATION BY REFERENCE

This application is based upon and claims the benefit of priority from the corresponding Japanese Patent Application No. 2013-012192 filed on Jan. 25, 2013, the entire contents of which are incorporated herein by reference.

BACKGROUND

The present disclosure relates to a sheet conveyance device, a document conveyance device, and an image forming apparatus.

An image forming apparatus having an image reading portion which reads a document (sheet) may be provided with a sheet conveyance device for conveying a document to a reading position of the image reading portion.

A sheet conveyance device of this type has a document conveyance path leading from a document table through a reading position to a sheet discharge tray. On the document conveyance path, a sheet feed roller, a registration roller, and, a plurality of conveying rollers are provided in this order from upstream (document table side) in the conveyance direction. When a document conveyance operation is started, the sheet feed roller feeds a document placed on the document table to the document conveyance path to convey the document in the conveyance direction. The registration roller stops advance of the document in the conveyance direction once, and then conveys the document in the conveyance direction. The reading position is provided downstream of the registration roller. The document having passed through the reading position is conveyed to the sheet discharge tray by the plurality of conveying rollers.

In this configuration, a plurality of documents may be fed in an overlapping manner to the document conveyance path. Therefore, a separating roller for separating one by one the plurality of documents fed in an overlapping manner is provided on a side of the document conveyance path opposite to the sheet feed roller (the sheet feed roller is disposed on the upper side of the document conveyance path and the separating roller is disposed on the lower side of the document conveyance path). Upon the document conveyance operation, the sheet feed roller is rotated in the conveyance direction while the separating roller is rotated in a direction opposite to the conveyance direction. Thus, even if a plurality of documents are fed in an overlapping manner, a document on the upper side to be fed at the present is conveyed in the conveyance direction by the sheet feed roller while a document on the lower side not to be fed at the present is returned in the direction opposite to the conveyance direction by the separating roller.

For example, the separating roller is connected to a torque limiter, so that when a feeding force exceeds a set critical value of the torque limiter, the separating roller is forward rotated (rotated so as to follow a document conveyed in the conveyance direction by the sheet feed roller). However, when a plurality of documents are fed in an overlapping manner so that a document on the lower side not to be fed at the present exists between the separating roller and a document on the upper side to be fed at the present, the feeding force does not exceed the set critical value of the torque limiter. Therefore, the document on the lower side not to be fed at the present is returned in the direction opposite to the conveyance direction by the separating roller rotating reversely.

SUMMARY

A sheet conveyance device according to one aspect of the present disclosure includes a sheet feed portion, a separating portion, a conveyance portion, a first sensor, and a second sensor. The sheet feed portion performs a feeding operation of feeding a sheet placed on a set tray to a sheet conveyance path and conveying the sheet from upstream to downstream in the sheet conveyance path. The separating portion is disposed opposing to the sheet feed portion via the sheet conveyance path, and performs a separating operation of returning a plurality of the sheets fed in an overlapping manner, from downstream to upstream in the sheet conveyance path, thereby separating one by one the sheets fed to the sheet conveyance path. The conveyance portion is disposed downstream of the sheet feed portion and conveys, downstream in the sheet conveyance path, the sheet conveyed from the sheet feed portion. The first sensor is used for detecting whether or not a sheet is present at a first position between the sheet feed portion and the conveyance portion. The second sensor is used for detecting whether or not the sheet is present at a second position between the sheet feed portion and the conveyance portion, the second position being located downstream of the first position in the sheet conveyance direction and being spaced from the first position in a sheet conveyance direction and in a direction intersecting the sheet conveyance direction. in the case where the sheet has not been detected at the second position when a predetermined time has elapsed since the sheet has been detected at the first position, the separating portion switches operation thereof from the separating operation to a non-separating operation of conveying the sheet from upstream to downstream in the sheet conveyance path, and the sheet feed portion continues the feeding operation. in the case where the sheet has not been detected at the second position by the time the predetermined time has elapsed since the separating portion has started the non-separating operation, the separating portion and the sheet feed portion stop driving, and where the sheet has been detected at the second position by the time, the separating portion switches operation thereof from the non-separating operation to the separating operation, and the sheet feed portion continues the feeding operation.

A document conveyance device according to another aspect of the present disclosure includes the sheet conveyance device which conveys a document as a sheet.

An image forming apparatus according to another aspect of the present disclosure includes an image forming portion which forms an image on a sheet, and the sheet conveyance device which conveys the sheet to the image forming portion.

An image forming apparatus according to another aspect of the present disclosure includes an image reading portion which reads a document image, an image forming portion which forms an image based on image data, and the document conveyance device which conveys a document as a sheet to the image reading portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

An embodiment of the present disclosure will be described using, as an example, an image forming apparatus (multifunction peripheral) capable of executing a plurality of jobs such as a print job and a scan job.

(Entire Configuration of Image Forming Apparatus)

Figure 1:
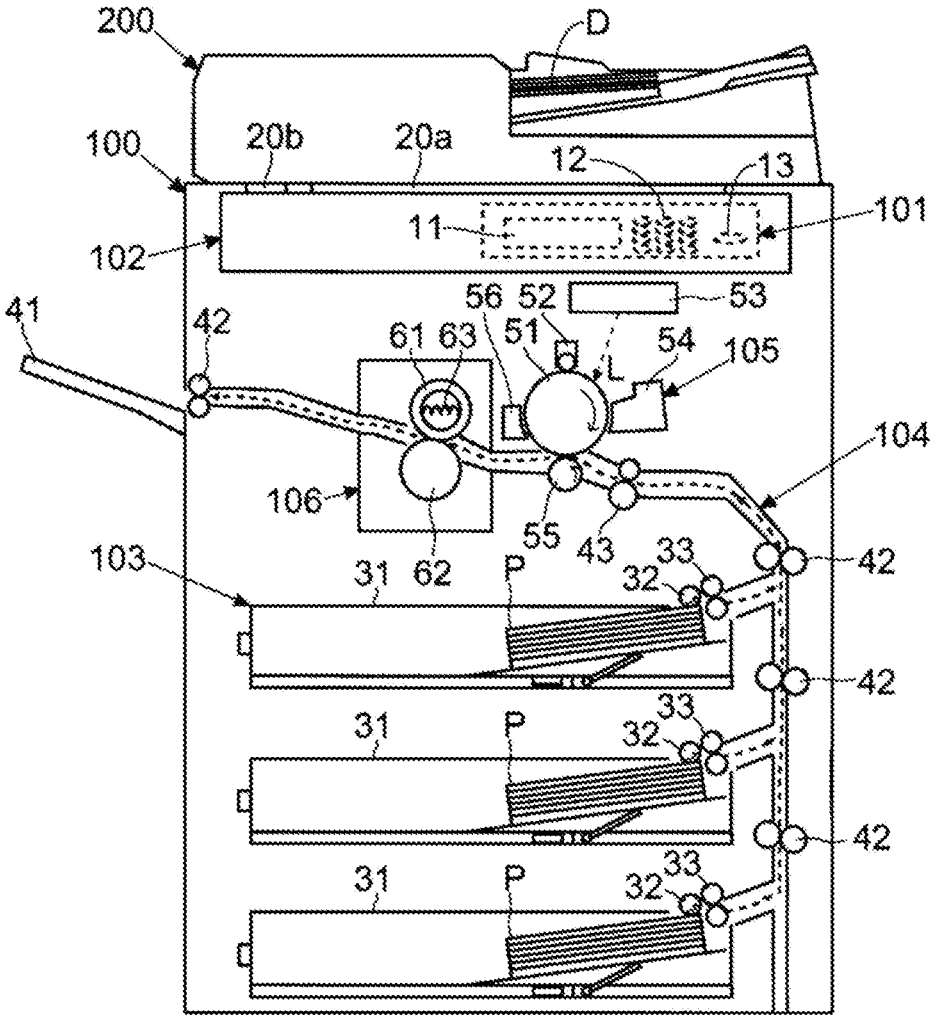
FIG. 1 is a schematic diagram of an image forming apparatus provided with a sheet conveyance device (document conveyance device) according to an embodiment of the present disclosure.

As shown in FIG. 1, an image forming apparatus 100 of the present embodiment includes an operation panel 101, an image reading portion 102, a paper feed portion 103, a paper conveyance portion 104, an image forming portion 105, and a fixing portion 106. A document conveyance device 200 corresponding to a sheet conveyance device of the present disclosure is disposed above the image forming apparatus 100 (above the image reading portion 102), and conveys a document D as a sheet.

The operation panel 101 includes a liquid crystal display portion 11 disposed on the apparatus front side and having a display surface covered by a touch panel. The liquid crystal display portion 11 displays a message indicating the apparatus state, a software key for receiving various inputs, and the like. In addition, on the operation panel 101, hardware keys such as a numerical keypad 12 and a start key 13 are also provided.

The image reading portion 102 reads (scans) one side of a document D to generate image data. The image reading portion 102 is provided with optical members such as an exposure lamp, a mirror, a lens, and an image sensor though not shown. The image reading portion 102 radiates light to a document D placed on a contact glass 20*a* by a user, and performs A/D conversion for an output value of an image sensor having received light reflected from the document D, thereby generating image data. Also, the image reading portion 102 radiates light to a document D conveyed onto a contact glass 20*b* by the document conveyance device 200, and performs A/D conversion for an output value of an image sensor having received light reflected from the document D, thereby generating image data. Thus, printing can be performed based on image data obtained by the image reading portion 102 scanning a document D, and the image data obtained by the scanning can be accumulated.

The paper feed portion 103 has a cassette 31 for accommodating paper sheets P, and feeds a paper sheet P in the cassette 31 to a paper conveyance path. The paper feed portion 103 is provided with a pickup roller 32 for drawing out one by one a paper sheet P in the cassette 31. In addition, the paper feed portion 103 is provided with a sheet feed roller pair 33 for feeding a paper sheet P drawn out from the cassette 31 to the paper conveyance path while suppressing multi feed of paper sheets P. The sheet feed roller pair 33 is composed of a sheet feed roller located on the upper side and a separating roller located on the lower side.

The paper conveyance portion 104 conveys a paper sheet P along the paper conveyance path, to eventually lead the paper sheet P to a sheet discharge tray 41. The paper conveyance portion 104 includes a plurality of conveying roller pairs 42 rotatably provided on the paper conveyance path. In addition, the paper conveyance portion 104 includes a registration roller pair 43 provided at a position (position just before the image forming apparatus 105) upstream of the image forming portion 105 in the paper conveyance direction. The registration roller pair 43 causes a paper sheet P to stand by just before the image forming portion 105, and feeds the paper sheet P to the image forming portion 105 at an appropriate timing.

The image forming portion 105 forms a toner image based on image data, and transfers the toner image onto a paper sheet P. The image forming portion 105 includes a photosensitive drum 51, a charging device 52, an exposure device 53, a developing device 54, a transfer roller 55, and a cleaning device 56.

Upon image formation, first, the photosensitive drum 51 is rotationally driven while the charging device 52 charges the surface of the photosensitive drum 51 at a predetermined potential. In addition, the exposure device 53 outputs a light beam L based on image data, to scan and expose the surface of the photosensitive drum 51, thereby forming an electrostatic latent image on the surface of the photosensitive drum 51. The developing device 54 supplies toner to the electrostatic latent image formed on the surface of the photosensitive drum 51, thereby developing the image.

The transfer roller 55 can be rotated being pressed to the surface of the photosensitive drum 51. The registration roller pair 43 causes a paper sheet P to enter between the transfer roller 55 and the photosensitive drum 51 at an appropriate timing. At this time, a transfer voltage is applied to the transfer roller 55. Thus, the toner image on the surface of the photosensitive drum 51 is transferred onto the paper sheet P. Thereafter, the cleaning device 56 removes residual toner and the like on the surface of the photosensitive drum 51.

The fixing portion 106 heats and pressurizes the toner image transferred on the paper sheet P, to fix the toner image. The fixing portion 106 includes a heating roller 61 and a pressurizing roller 62. The heating roller 61 has a heater 63 provided therein. The pressurizing roller 62 is pressed to the heating roller 61. The paper sheet P having the toner image transferred thereon passes between the heating roller 61 and the pressurizing roller 62, whereby the paper sheet P is heated and pressurized. Thus, the toner image is fixed on the paper sheet P, and thus printing is completed. Thereafter, the printed paper sheet P is conveyed to the sheet discharge tray 41 by the conveying roller pair 42.

It is noted that the image forming apparatus 100 is provided with, besides the image reading portion 102 for reading one side of a document D, a CIS unit 107 (see FIG. 2) for reading the other side opposite to the one side of the document D. The CIS unit 107 is located at, for example, a predetermined position along a later-described document conveyance path 22 of the document conveyance device 200. Thus, it becomes possible to simultaneously read both sides of a document D.

(Configuration of Document Conveyance Device)

Figure 2:
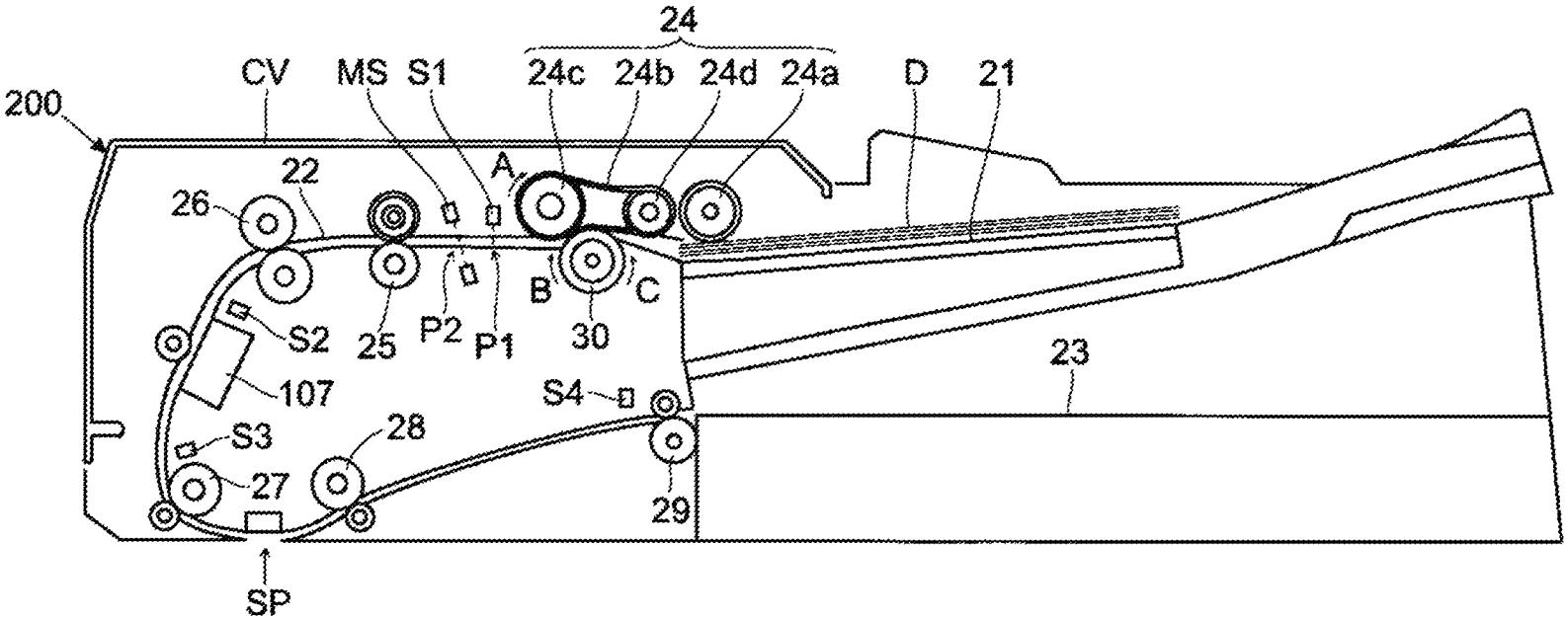
FIG. 2 is a detailed diagram of the sheet conveyance device provided on the image forming apparatus shown in FIG. 1.

As shown in FIG. 2, the document conveyance device 200 feeds a document D placed on a document set tray 21 to the document conveyance path 22 (corresponding to a "sheet conveyance path" of the present disclosure), conveys the document D along the document conveyance path 22, and then eventually discharges the document D to a document discharge tray 23. A certain position on the document conveyance path 22 is a reading position SP (position opposing to the contact glass 20*b*). When the document D is conveyed to the reading position SP, one side (side facing upward when the document D is set on the document set tray 21) of the document D is read by the image reading portion 102.

On the document conveyance path 22, a sheet feed portion 24, a registration roller pair 25, a conveying roller pair 26, a conveying roller pair 27, a conveying roller pair 28, and a sheet discharge roller pair 29 are provided in this order from upstream (document set tray 21 side) to downstream. It is noted that the registration roller pair 25 corresponds to a "conveyance portion" and a "registration portion" of the present disclosure.

The sheet feed portion 24 performs an operation (feeding operation) of drawing out a document D placed on the document set tray 21, to feed the document D to the document conveyance path 22, and conveying the document D from upstream to downstream in the document conveyance path 22. The sheet feed portion 24 includes a pickup roller 24*a* for drawing out a document D placed on the document set tray 21, and a sheet feed belt 24*b* for feeding the document D drawn out from the document set tray 21, to the document conveyance path 22, and conveying the document D from upstream to downstream in the document conveyance path 22.

The sheet feed belt 24*b* is stretched over a sheet feed roller 24*c* as a driving roller, and a driven roller 24*d*, and circulates by the sheet feed roller 24*c* rotating. The circulation direction of the sheet feed belt 24*b* (rotation direction of the sheet feed roller 24*c*) is a direction (direction A) that allows a document D to be conveyed from upstream to downstream in the document conveyance path 22. Thus, when the document D drawn out from the document set tray 21 contacts the sheet feed belt 24*b*, the document D is fed to the document conveyance path 22 and conveyed from upstream to downstream in the document conveyance path 22.

In addition, a separating roller 30 is provided at a position opposing to the sheet feed portion 24 (sheet feed belt 24*b*) via the document conveyance path 22. It is noted that the separating roller 30 corresponds to a "separating portion" of the present disclosure. The separating roller 30 is provided for, when a plurality of documents D overlap with each other, separating one by one the plurality of overlapping documents D.

Specifically, while the sheet feed portion 24 is performing a feeding operation, the separating roller 30 performs an operation (separating operation) of returning a document D from downstream to upstream in the document conveyance path 22. That is, the separating roller 30 rotates in one direction (direction B) in which a document D is returned from downstream to upstream in the document conveyance path 22. Therefore, when a plurality of documents D overlap, a document D on the upper side to be conveyed at the present (document D contacting the sheet feed portion 24) is conveyed from upstream to downstream in the document conveyance path 22 by the sheet feed portion 24. On the other hand, a document D on the lower side not to be conveyed at the present (document D contacting the separating roller 30) is returned from downstream to upstream in the document conveyance path 22 by the separating roller 30 (or stays at its present position). Thus, the plurality of overlapping documents D are separated one by one.

Figure 5:
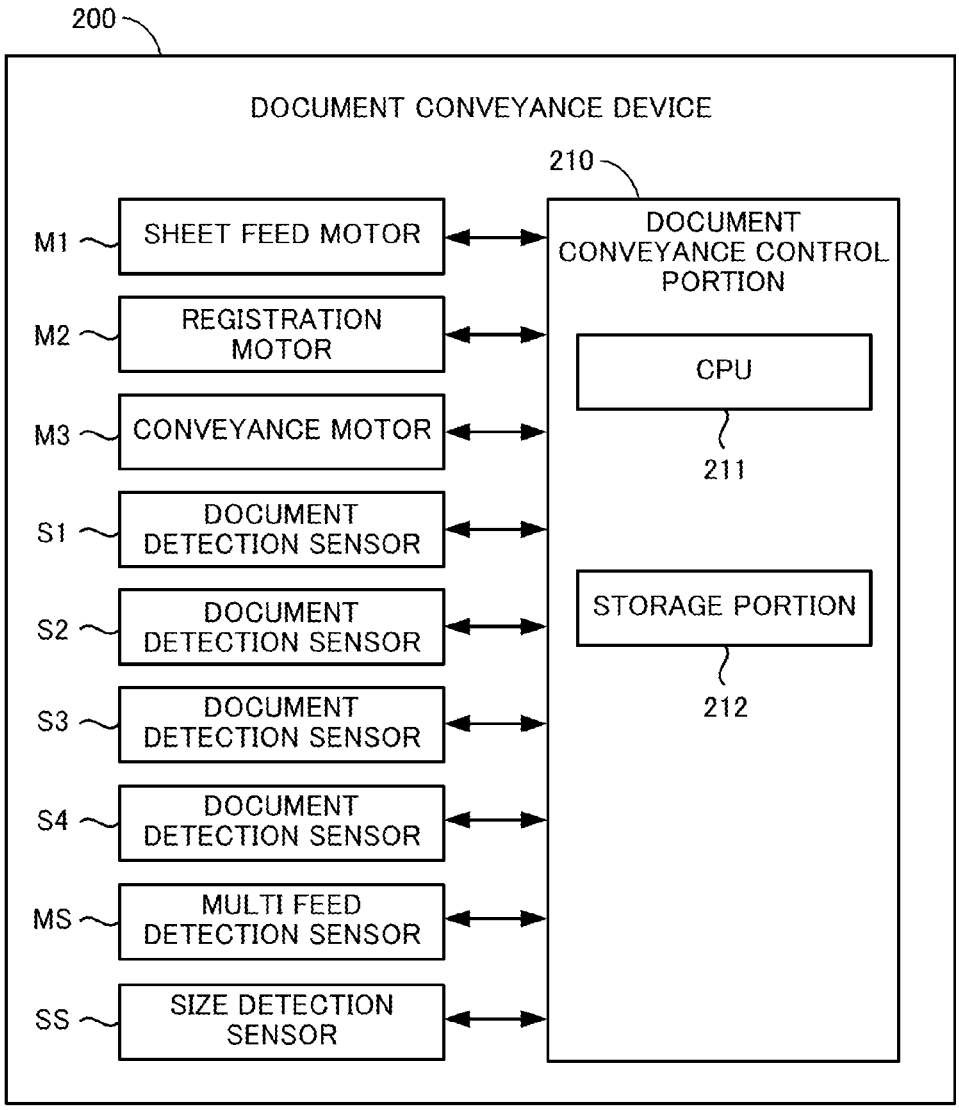
FIG. 5 is a block diagram for explaining the hardware configuration of the sheet conveyance device shown in FIG. 2.

The sheet feed portion 24 and the separating roller 30 are driven by the same sheet feed motor M1 (see FIG. 5). In addition, the separating roller 30 also rotates in the other direction (direction C) opposite to the one direction (direction B) when rotation of the sheet feed motor M1 is switched from forward rotation to reverse rotation. That is, the separating roller 30 can also perform an operation (non-separating operation) of conveying a document D from upstream to downstream in the document conveyance path 22.

It is noted that a drive transmission mechanism (not shown) for transmitting a driving force of the sheet feed motor M1 (see FIG. 5) to the sheet feed portion 24 outputs forward rotation drive of the sheet feed motor M1 as a driving force for forward rotation, and outputs reverse rotation drive of the sheet feed motor M1 also as a driving force for forward rotation. Thus, even when the sheet feed motor M1 is rotating reversely, the sheet feed portion 24 continues a feeding operation (the sheet feed belt 24*b* circulates in the direction A). Such a drive transmission mechanism has a configuration including two one-way clutches, for example.

The registration roller pair 25 stops advance of the leading end of a document D from upstream to downstream in the document conveyance path 22 once, to deflect the document D, thus correcting skew, and thereafter, conveys the document D from upstream to downstream in the document conveyance path 22. That is, the registration roller pair 25 is not rotating at the time when the leading end of the document D has reached, and starts to rotate after the leading end of the document D has reached. Thus, even if skew has occurred at the time when the document D has reached the registration roller pair 25, the skew is corrected. The registration roller pair 25 is independently driven by a registration motor M2 (see FIG. 5).

The conveying roller pairs 26 to 28 each convey the document D from upstream to downstream in the document conveyance path 22. In addition, the sheet discharge roller pair 29 discharges the document D advancing in the document conveyance path 22, to the document discharge tray 23. It is noted that the conveying roller pairs 26 to 28 and the sheet discharge roller pair 29 are driven by the same conveyance motor M3 (see FIG. 5).

In addition, the document conveyance device 200 is provided with document detection sensors S1, S2, S3, and S4 for detecting whether or not a document D is present and for determining a timing of conveying a document D. These document detection sensors S1 to S4 are, for example, reflection-type optical sensors having light emitting portions which emit light toward a detection target and light receiving portions which receive light reflected from the detection target. Each output of the document detection sensors S1 to S4 varies depending on whether or not a document D is present at each corresponding detection position.

The document detection sensor S1 is a sensor for detecting whether or not a document D is present at a position (position on the downstream side of the sheet feed portion 24) between the sheet feed portion 24 and the registration roller pair 25 on the document conveyance path 22. It is noted that the document detection sensor S1 corresponds to a "first sensor" of the present disclosure. The document detection sensor S2 is a sensor for detecting whether or not a document D is present at a position (position in the vicinity of the conveying roller pair 26) between the conveying roller pair 26 and the conveying roller pair 27 on the document conveyance path 22. The document detection sensor S3 is a sensor for detecting whether or not a document D is present at a position (position in the vicinity of the conveying roller pair 27) between the conveying roller pair 26 and the conveying roller pair 27 on the document conveyance path 22. The document detection sensor S4 is a sensor for detecting whether or not a document D is present at a position (position in the vicinity of the sheet discharge roller pair 29) between the conveying roller pair 28 and the sheet discharge roller pair 29 on the document conveyance path 22.

Further, the document conveyance device 200 is also provided with a multi feed detection sensor MS for detecting whether or not a document D is present and for detecting occurrence of multi feed such as later-described overlap feed. It is noted that the multi feed detection sensor MS corresponds to a "second sensor" of the present disclosure. The multi feed detection sensor MS includes, for example, a transmission portion which transmits an ultrasonic wave, a reception portion which receives the ultrasonic wave from the transmission portion, and a hold circuit (for example, a capacitor) which stores electric charge outputted from the reception portion, and the output of the multi feed detection sensor MS varies in accordance with the amount of the ultrasonic wave transferred from the transmission portion to the reception portion. The transmission portion and the reception portion of the multi feed detection sensor MS are disposed opposing to each other via the document conveyance path 22. Therefore, when a document D is conveyed to the detection position of the multi feed detection sensor MS, the document D is interposed between the transmission portion and the reception portion of the multi feed detection sensor MS. The output of the multi feed detection sensor MS at this time varies in accordance with whether or not a document D is present and the number of overlapping documents D, because the larger the number of documents D present at the detection position is, the smaller the amount of the ultrasonic wave transferred from the transmission portion to the reception portion is.

That is, in the case where a document D is present at the detection position (position between the transmission portion and the reception portion) of the multi feed detection sensor MS, the amount of the ultrasonic wave transferred from the transmission portion to the reception portion is smaller than in the case where a document D is not present at the detection position of the multi feed detection sensor MS. Therefore, the output level of the multi feed detection sensor MS differs between the case where a document D is present at the detection position of the multi feed detection sensor MS and the case where a document D is not present. In addition, in the case where a plurality of documents D are conveyed in an overlapping manner to the detection position of the multi feed detection sensor MS, the amount of the ultrasonic wave transferred from the transmission portion to the reception portion is smaller than in the case where only one document D is conveyed to the detection position of the multi feed detection sensor MS. Therefore, the output level of the multi feed detection sensor MS differs between the case where a plurality of documents D are conveyed in an overlapping manner to the detection position of the multi feed detection sensor MS and the case where only one document D is conveyed. Therefore, at the detection position of the multi feed detection sensor MS, not only whether or not a document D is present but also occurrence of multi feed such as overlap feed can be detected.

As in the detection position of the document detection sensor S1, the detection position of the multi feed detection sensor MS is a position (position on the downstream side of the sheet feed portion 24) between the sheet feed portion 24 and the registration roller pair 25 on the document conveyance path 22. That is, the registration roller pair 25 is located downstream of the detection position of the multi feed detection sensor MS. Hereinafter, the detection position of the document detection sensor S1 is referred to as a first position P1, and the detection position of the multi feed detection sensor MS is referred to as a second position P2.

Figure 3:
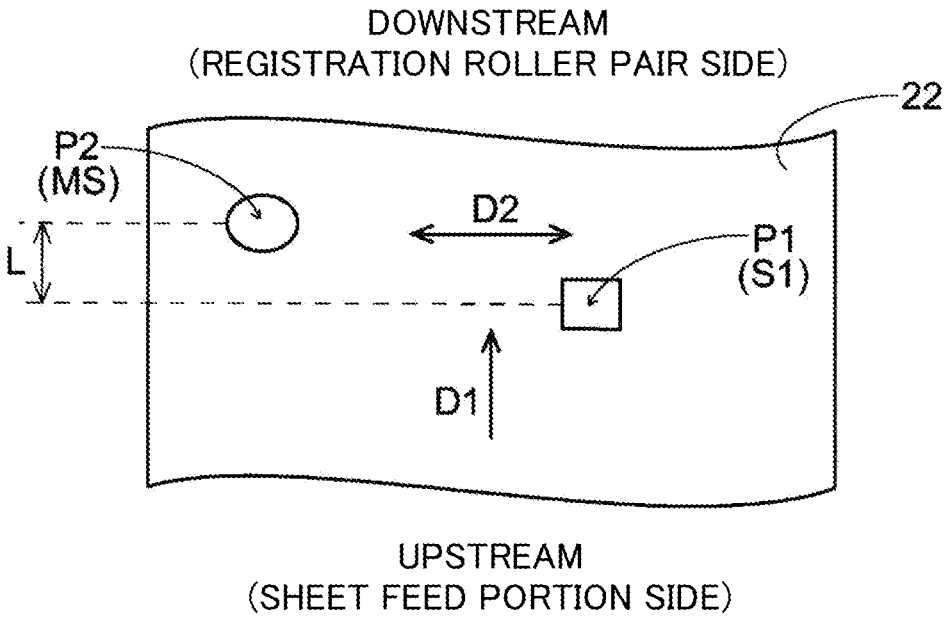
FIG. 3 is a schematic diagram for explaining detection positions of sensors for skew detection (first sensor and second sensor) provided in the sheet conveyance device shown in FIG. 2.

As shown in FIG. 3, the first position P1 which is the detection position of the document detection sensor S1, and the second position P2 which is the detection position of the multi feed detection sensor MS are displaced from each other in a document conveyance direction D1 and in a direction D2 intersecting (perpendicular to) the document conveyance direction D1. Specifically, the first position P1 is a position displaced toward one side from the center in the direction D2. In addition, the second position P2 is a position displaced toward the other side (side opposite to the one side) from the center in the direction D2. Further, the second position P2 is located downstream of the first position P1. For example, a distance L between the first position P1 and the second position P2 in the document conveyance direction D1 is about 9.5 mm. The reason why the first position P1 and the second position P2 are displaced from each other in the document conveyance direction D1 and in the direction D2 intersecting (perpendicular to) the document conveyance direction D1, is to perform skew detection based on the outputs of the document detection sensor S1 and the multi feed detection sensor MS. The skew detection will be described later in detail.

Returning to FIG. 2, the document set tray 21 is provided with a size detection sensor SS (see FIG. 5) for detecting the size of a document D placed on the document set tray 21. The size detection sensor SS is, for example, an optical sensor, and its output varies in accordance with the size of a document D placed on the document set tray 21.

In addition, a part of the document conveyance path 22 is covered by a cover CV which is openable and closable. The cover CV covers the upper side (portion where the sheet feed portion 24, the registration roller pair 25, the conveying roller pair 26, and the like are provided) of the document conveyance path 22, and is opened, for example, upon jam processing. It is noted that the sheet feed portion 24, the document detection sensor S1, and the multi feed detection sensor MS are unitized and fixed so as not to move from their provided positions. Therefore, even if the cover CV is opened, the sheet feed portion 24, the document detection sensor S1, and the multi feed detection sensor MS remain at their original provided positions without moving, and occurrence of position displacement of the sheet feed portion 24, the document detection sensor S1, and the multi feed detection sensor MS is suppressed.

(Hardware Configurations of Image Forming Apparatus and Document Conveyance Device)

Figure 4:
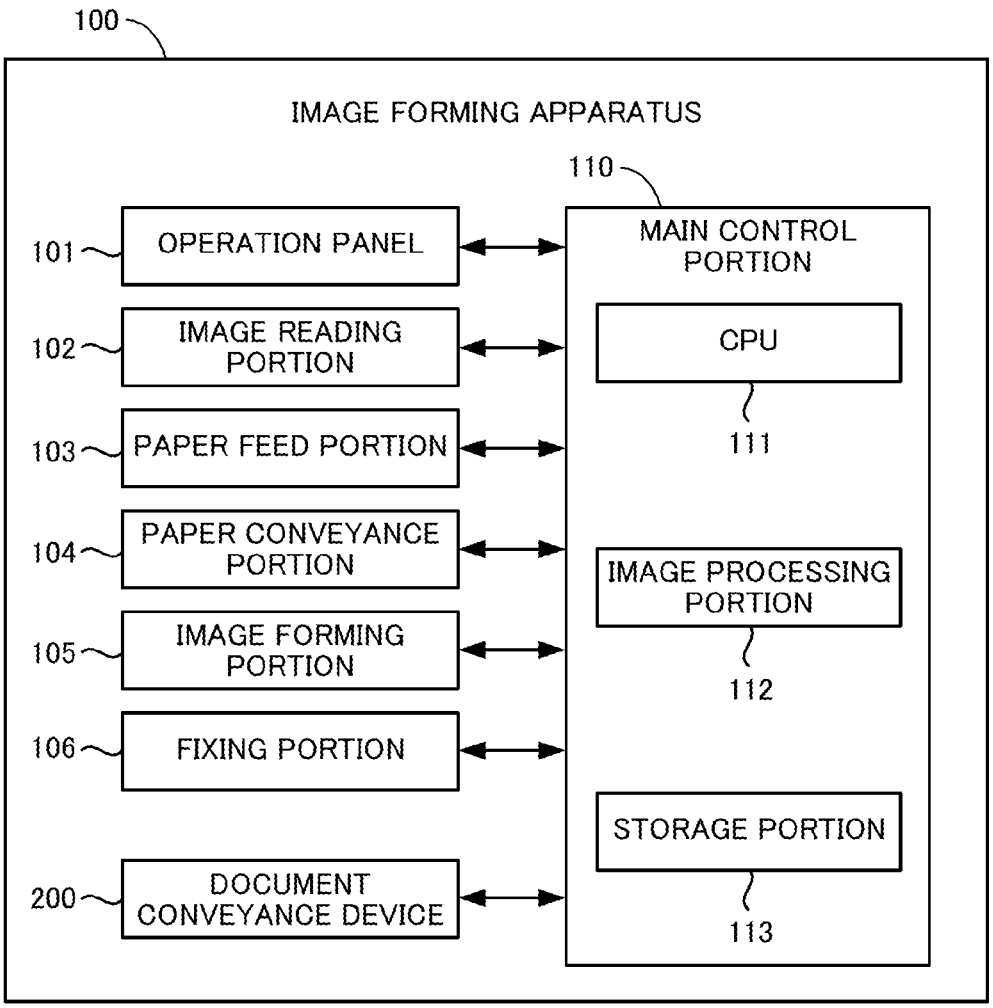
FIG. 4 is a block diagram for explaining the hardware configuration of the image forming apparatus shown in FIG. 1.

As shown in FIG. 4, the image forming apparatus 100 includes a main control portion 110 which controls the entire apparatus. The main control portion 110 includes a CPU 111, an image processing portion 112, and a storage portion 113. The image processing portion 112 includes an ASIC and a memory dedicated for image processing, and the like, and performs various image processes (expansion/reduction, density conversion, data form conversion, etc.) for image data. The storage portion 113 includes a ROM, a RAM, and the like. For example, a program and data needed for executing a job are stored in the ROM, and the program and data are expanded on the RAM.

The operation panel 101, the image reading portion 102, the paper feed portion 103, the paper conveyance portion 104, the image forming portion 105, and the fixing portion 106 are connected to the main control portion 110, and operate based on instructions from the main control portion 110. Further, the main control portion 110 is connected to the document conveyance device 200.

As shown in FIG. 5, the document conveyance device 200 has a document conveyance control portion 210 connected to the main control portion 110. The document conveyance control portion 210 includes a CPU 211 and a storage portion 212. In response to an instruction from the main control portion 110, the document conveyance control portion 210 controls the document conveyance operation of the document conveyance device 200. Specifically, the document conveyance control portion 210 controls drive of the sheet feed motor M1, the registration motor M2, and the conveyance motor M3, to rotate each roller or stop the rotation.

In addition, the document conveyance control portion 210 detects the leading end and the rear end of a document D (detects that the document D has reached and that the document D has passed) at each detection position including the first position P1, based on each output of the document detection sensors 51 to S4. Then, the document conveyance control portion 210 determines the conveyance state (whether or not jam or the like has occurred) of the document D.

Further, the document conveyance control portion 210 determines timings of starting and stopping rotation of each roller, based on each output of the document detection sensors S1 to S4. For example, in response to an instruction to start to convey a document D from the main control portion 110, the document conveyance control portion 210 drives the sheet feed motor M1 to start a feeding operation and a separating operation (rotate the pickup roller 24*a*, the sheet feed roller 24*c*, and the separating roller 30). Then, the document conveyance control portion 210 detects that the document D has reached the first position P1, based on output of the document detection sensor 51. Thereafter, the document conveyance control portion 210 drives the registration motor M2 to rotate the registration roller pair 25. That is, the document D having reached the registration roller pair 25 is deflected to a certain degree, thereby correcting skew, and then the document D is conveyed downstream of the registration roller pair 25. At this time, skew that is comparatively small is corrected. Subsequently, the document conveyance control portion 210 drives the conveyance motor M3 to rotate the conveying roller pairs 26 to 28 and the sheet discharge roller pair 29. Thus, the document D passes through the reading position SP and then reaches the document discharge tray 23.

In addition, the document conveyance control portion 210 receives output of the multi feed detection sensor MS. Then, the document conveyance control portion 210 detects multi feed such as overlap feed, based on the output of the multi feed detection sensor MS. For example, a threshold value for multi feed detection is stored in the storage portion 212. The document conveyance control portion 210 detects whether or not multi feed such as overlap feed has occurred, based on whether the output level of the multi feed detection sensor MS is greater or smaller than the threshold value for multi feed detection.

In addition, the document conveyance control portion 210 receives output of the size detection sensor SS. Then, the document conveyance control portion 210 recognizes the size of a document D placed on the document set tray 21, based on the output of the size detection sensor.

(Skew Detection Operation)

First, with reference to FIGS. 6 to 10, a skew detection operation in the case where a document D is fed in a skewed manner to the document conveyance path 22 will be described as an example. In the following description, it will be assumed that a plurality of documents D stapled by a staple ST are erroneously placed on the document set tray 21, as an example. It is noted that in FIGS. 6 to 10 which will be referred to in the following description, in order to make it easy to see the drawings, the positional relationship between the documents D and each of the first position P1 and the second position P2 are schematically shown while the other members are not shown.

Figure 6:
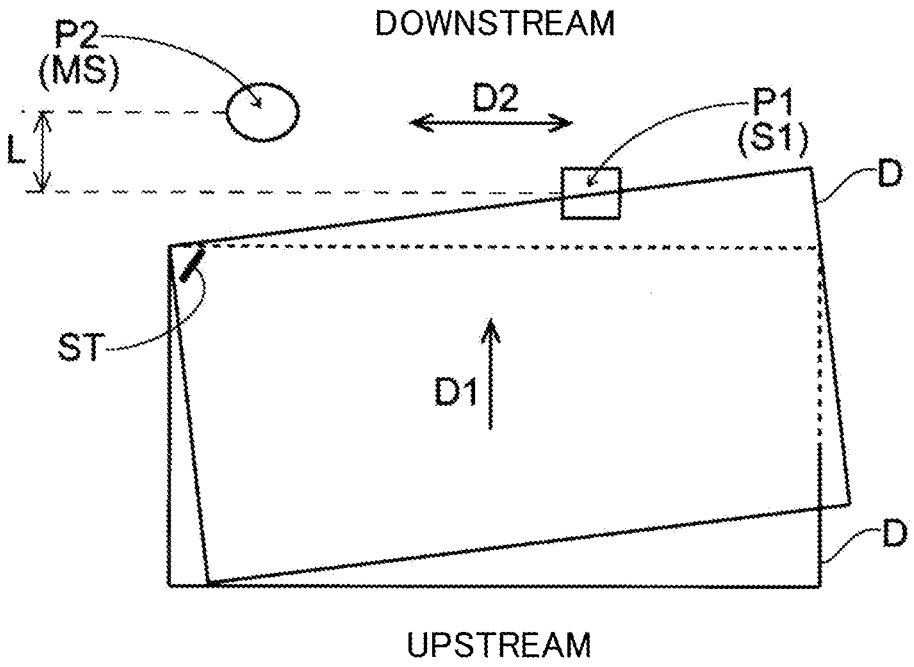
FIG. 6 is a schematic diagram for explaining a skew detection operation performed in the sheet conveyance device shown in FIG. 2.

When a plurality of documents D stapled by a staple ST are erroneously placed on the document set tray 21 and the documents D are fed to the document conveyance path 22, as shown in FIG. 6, skew so great that the document D will jam (the skew will not be fully corrected) is likely to occur. The reason is that, of the document D, a part that is not stapled tends to advance in the document conveyance direction D1 while a stapled part tends to stay at its present position. It is noted that even in the case where documents D are not stapled, the document D can greatly skew when the document D is fed to the document conveyance path 22, depending on the placement condition of the document D on the document set tray 21.

In the case where, of the document D, a preceding part is a part on one side (first position P1 side) in the direction D2 and a succeeding part is a part on the other side (second position P2 side) in the direction D2, when the part on the one side of the document D has reached the first position P1, the part on the other side of the document D has not reached a position on a line extending in the direction D2 from the first position P1. At this time, the document conveyance control portion 210 detects that the document D has reached the first position P1, based on output of the document detection sensor S1.

Here, if the document D detected at the first position P1 has not greatly skewed, when a predetermined time has elapsed since the document D has been detected at the first position P1

(at about the time when the document D detected at the first position P1 should reach the second position P2), the part on the other side of the document D reaches the second position P2 without delay. It is noted that the predetermined time is a predicted time required for the document D to advance the distance L between the first position P1 and the second position P2 in the document conveyance direction D1, and can be calculated beforehand based on the distance L and the conveyance speed. The term "predetermined time" used in the following description always means "predicted time required for the document D to advance the distance L between the first position P1 and the second position P2 in the document conveyance direction D1".

Therefore, when the predetermined time has elapsed since it has been detected that the document D has reached the first position P1, the document conveyance control portion 210 detects that the document D has reached the second position P2, based on output of the multi feed detection sensor MS. Then, the document conveyance control portion 210 determines that skew has not occurred. In this case, the sheet feed portion 24 continues the feeding operation of conveying the document D from upstream to downstream in the document conveyance path 22 (continues circulation of the sheet feed belt 24*b* in the direction A). In addition, the separating roller 30 continues the separating operation of returning the document D from downstream to upstream in the document conveyance path 22 (continues rotation in the direction B).

Figure 7:
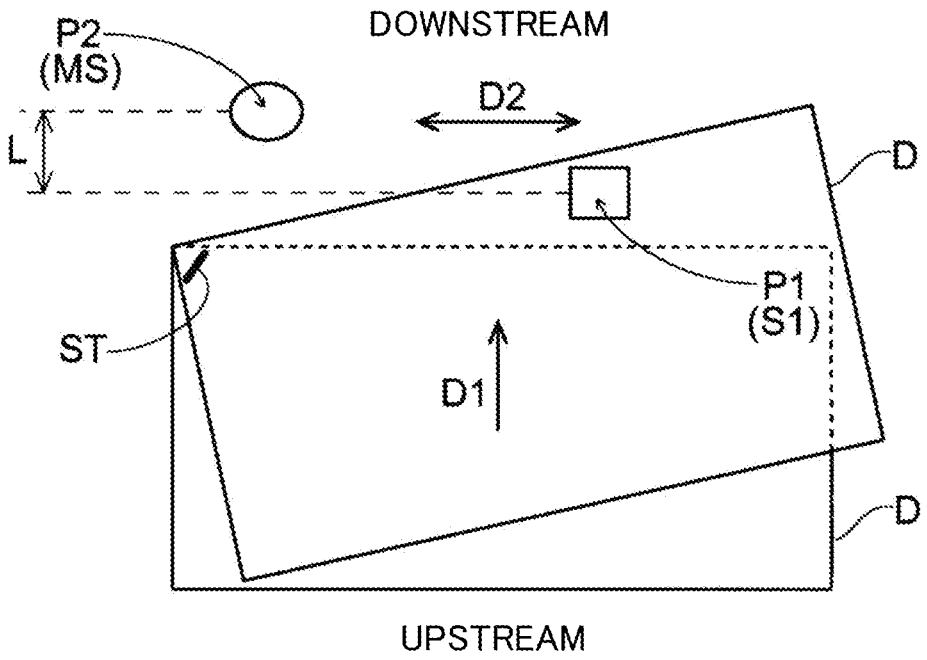
FIG. 7 is a schematic diagram for explaining the skew detection operation performed in the sheet conveyance device shown in FIG. 2.

On the other hand, if the document D detected at the first position P1 has greatly skewed, as shown in FIG. 7, even when the predetermined time has elapsed since the document D has been detected at the first position P1, the part on the other side of the document D has not reached the second position P2. That is, the output level of the multi feed detection sensor MS has not become a level indicating presence of the document D. Therefore, when the predetermined time has elapsed since it has been detected that the document D has reached the first position P1, the document conveyance control portion 210 has not detected that the document D has reached the second position P2. Therefore, conventionally, if the document D has not been detected at the second position P2 when the predetermined time has elapsed since the document D has been detected at the first position P1, the sheet feed portion 24 and the separating roller 30 stop driving (the document conveyance operation including the feeding operation and the separating operation is stopped).

However, in the present embodiment, even if the document D has not been detected at the second position P2 when the predetermined time has elapsed since the document D has been detected at the first position P1, the document conveyance operation is not stopped at this point of time. That is, the sheet feed portion 24 continues the feeding operation of conveying the document D from upstream to downstream in the document conveyance path 22 (continues circulation of the sheet feed belt 24*b* in the direction A). However, the separating roller 30 switches its operation from the separating operation of returning the document D from downstream to upstream in the document conveyance path 22, to a non-separating operation of conveying the document D from upstream to downstream in the document conveyance path 22 (switches the rotation direction from the direction B to the direction C). Therefore, the document D advances in the document conveyance direction D1 in a greatly skewed manner. The reason for performing such control will be described later in detail.

Figure 8:
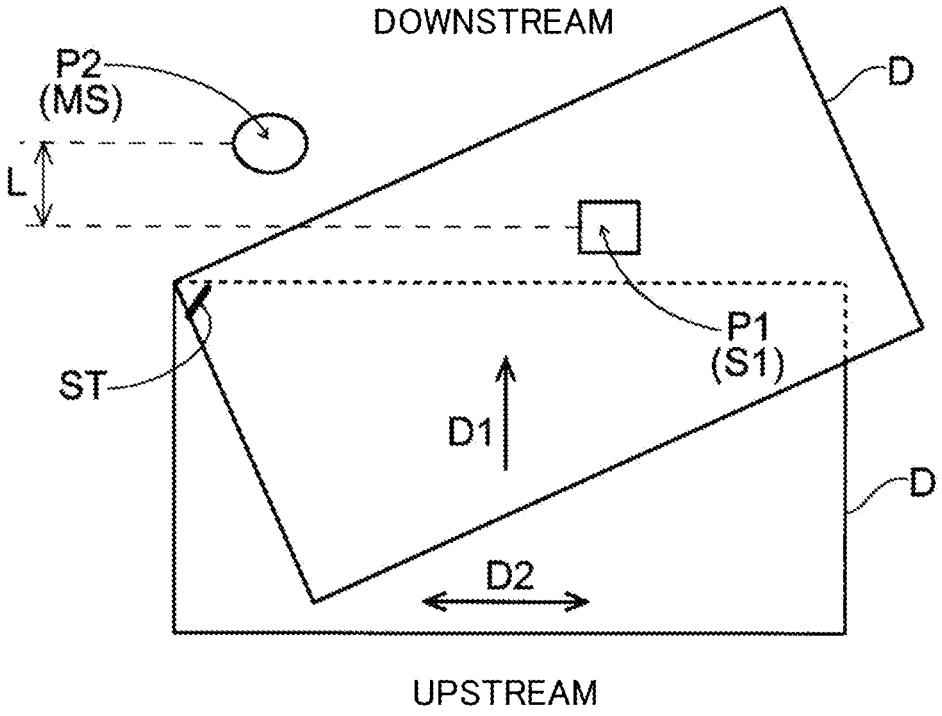
FIG. 8 is a schematic diagram for explaining the skew detection operation performed in the sheet conveyance device shown in FIG. 2.

Here, in the state shown in FIG. 7 (the state further progressed from the state shown in FIG. 6), the part on the one side (first position P1 side) of the document D precedes the part on the other side (second position P2 side). Since the part on the other side of the document D is stapled by the staple ST, the part on the other side of the document D tends to stay at its present position. Therefore, as shown in FIG. 8, even when the predetermined time has elapsed since the separating roller 30 has started the non-separating operation, the part on the other side of the document D has not reached the second position P2. It is noted that even in the case where the documents D are not stapled, if skew of the document D is great, the part on the other hand of the document D does not reach the second position P2 by the time the predetermined time has elapsed since the separating roller 30 has started the non-separating operation.

If the document D detected at the first position P1 has not greatly skewed, when the part on the one side (first position P1 side) of the document D has reached the first position P1, the part on the other side (second position P2 side) of the document D has reached a position on a line extending in the direction D2 from the first position P1. Therefore, the part on the other hand of the document D reaches the second position P2 by the time the predetermined time has elapsed since the separating roller 30 has started the non-separating operation.

Accordingly, based on output of the multi feed detection sensor MS, the document conveyance control portion 210 detects whether or not the document D has reached the second position P2 by the time the predetermined time has elapsed since the separating roller 30 has started the non-separating operation. As a result, if the document conveyance control portion 210 has detected that the document D has not reached the second position P2, the document conveyance control portion 210 determines that skew has occurred. Then, the sheet feed portion 24 and the separating roller 30 stop driving (the document conveyance operation including the feeding operation and the separating operation is stopped).

On the other hand, if the document conveyance control portion 210 has detected that the document D has reached the second position P2 by the time the predetermined time has elapsed since the separating roller 30 has started the non-separating operation, the document conveyance control portion 210 determines that skew has not occurred. In this case, the sheet feed portion 24 continues the feeding operation on the document conveyance path 22 (continues circulation of the sheet feed belt 24*b* in the direction A). In addition, the separating roller 30 switches its operation from the non-separating operation to the separating operation (switches the rotation direction from the direction C to the direction B).

Figure 9:
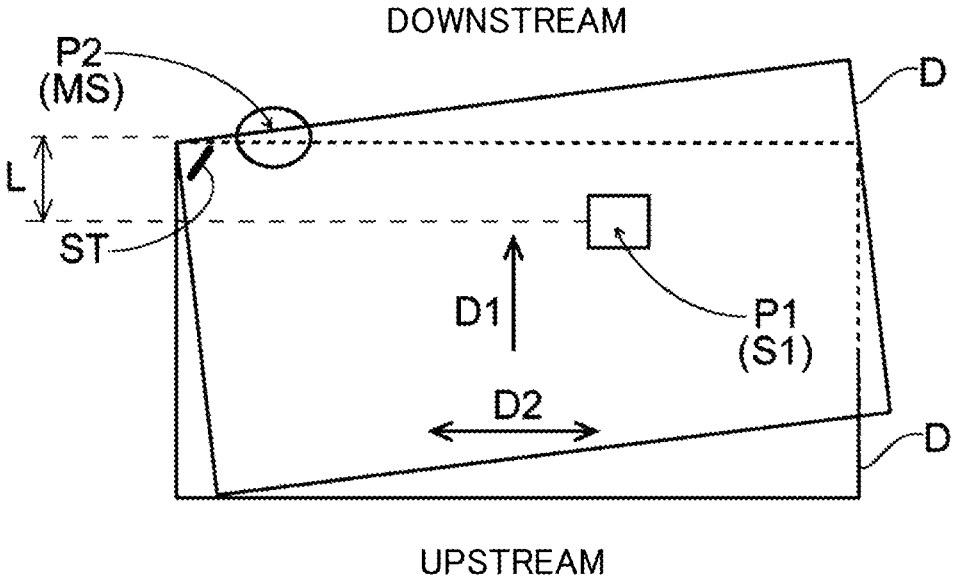
FIG. 9 is a schematic diagram for explaining the skew detection operation performed in the sheet conveyance device shown in FIG. 2.

It is noted that also during the period until the separating roller 30 stops the separating operation and starts the non-separating operation, the sheet feed portion 24 continues the feeding operation. In this period, the document D on the upper side may advance in the document conveyance direction D1 while drawing the document D on the lower side. Therefore, as shown in FIG. 9, the part on the other side of the document D may reach the second position P2 by the time the predetermined time has elapsed since the separating roller 30 has started the non-separating operation. However, in this case, the output level of the multi feed detection sensor MS becomes a level indicating occurrence of multi feed, and therefore the document conveyance control portion 210 detects occurrence of multi feed based on the output of the multi feed detection sensor MS. Then, in response to the detection of occurrence of multi feed, the sheet feed portion 24 and the separating roller 30 stop driving (the document conveyance operation including the feeding operation and the separating operation is stopped). Therefore, the document conveyance operation is prevented from being continued in the state shown in FIG. 9.

Figure 10:
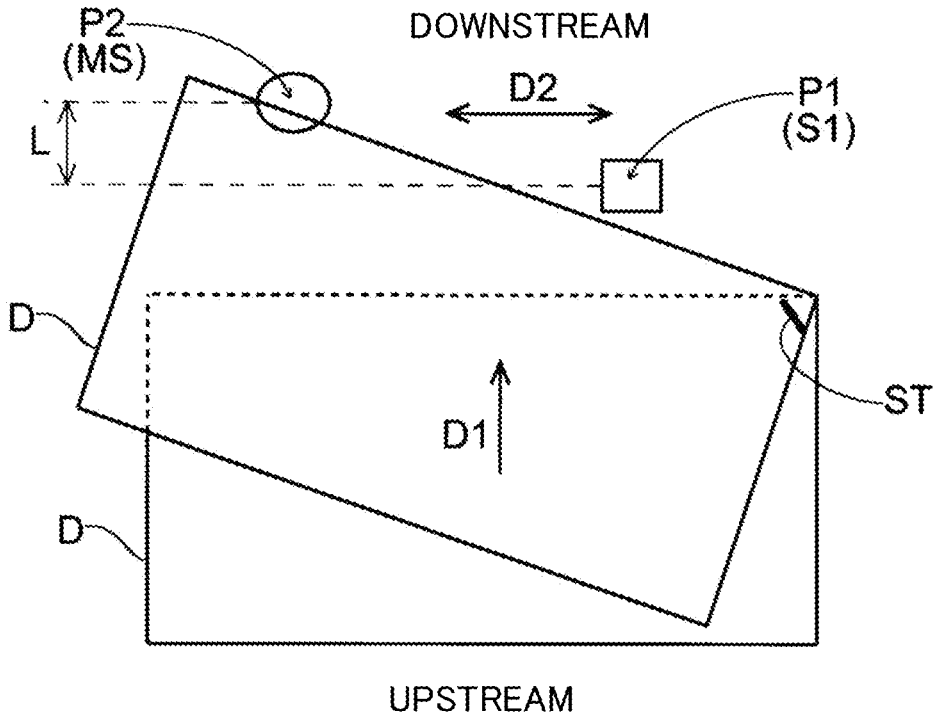
FIG. 10 is a schematic diagram for explaining the skew detection operation performed in the sheet conveyance device shown in FIG. 2.

As shown in FIG. 10, of the document D, the part on the other side (second position P2 side) in the direction D2 may precede the part on the one side (first position P1 side), so that the part on the other side of the document D may reach the second position P2 before the part on the one side of the document D reaches the first position P1. For example, in the case where the part on the one side of the document D is stapled by the staple ST and the part on the other side of the document D is not stapled, skew as shown in FIG. 10 is likely to occur. When such skew has occurred, the document conveyance control portion 210 detects that the document D has reached the second position P2 without detecting that the document D has reached the first position P1. Then, when the document D has been detected at the second position P2 without detection of the document D at the first position P1, the sheet feed portion 24 and the separating roller 30 stop driving (the document conveyance operation including the feeding operation and the separating operation is stopped). Thus, the document conveyance operation is prevented from being continued in the state shown in FIG. 10.

Next, with reference to FIGS. 11 to 16, a skew detection operation in the case where a document D is fed to the document conveyance path 22 without greatly skewing will be described as an example. In the following description, as an example, it will be assumed that overlap feed has occurred so that, of a plurality of documents D placed on the document set tray 21, a document D on the lower side not to be fed at the present is fed first and a document D on the upper side to be fed at the present is fed being overlapping with the document D on the lower side. For example, in the case where, of the plurality of documents D placed on the document set tray 21, the leading end of a document D on the lower side is placed thereon in a displaced state so as to precede the leading end of a document D on the upper side, overlap feed may occur. In addition, in the following description, overlap feed in which skew is not great is simply referred to as overlap feed. It is noted that in FIGS. 11, 13, and 15 which will be referred to in the following description, in order to make it easy to see the drawings, the positional relationship between the documents D and each of the first position P1 and the second position P2 are schematically shown while the other members are not shown. In addition, outlined arrows in FIGS. 13 and 15 indicate the advancing direction of each of the documents D on the upper side and the lower side.

Figure 11:
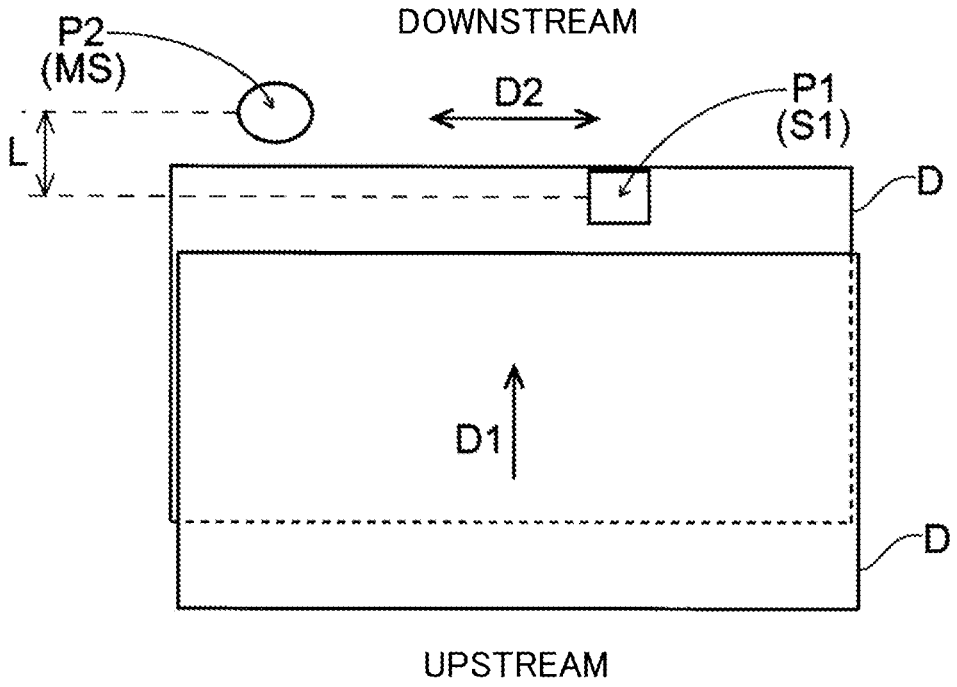
FIG. 11 is a schematic diagram for explaining the skew detection operation performed in the sheet conveyance device shown in FIG. 2 (in the case where overlap feed occurs).
Figure 12:
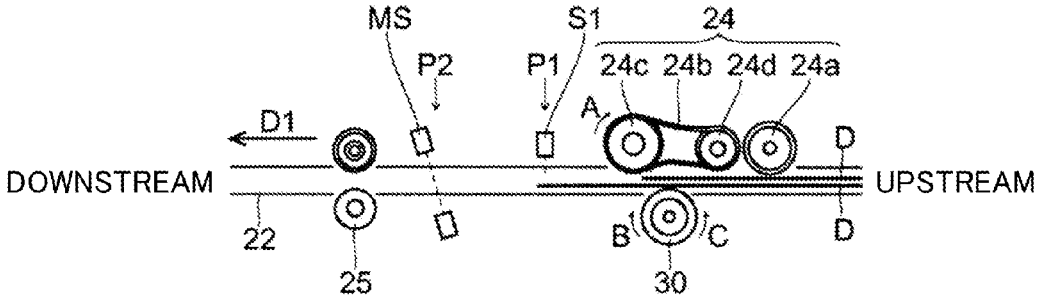
FIG. 12 is a schematic diagram for explaining the skew detection operation performed in the sheet conveyance device shown in FIG. 2 (in the case where overlap feed occurs).

When overlap feed has occurred, as shown in FIGS. 11 and 12, before the document D on the upper side reaches a feed nip formed by the sheet feed portion 24 and the separating roller 30 (or at the same time when the document D on the upper side has reached the feed nip), the document D on the lower side may reach the first position P1. At this time, the document conveyance control portion 210 detects that the document D has reached the first position P1, based on output of the document detection sensor S1.

In addition, when the document D on the upper side has reached the feed nip, the document D on the lower side contacts only the separating roller 30 without contacting the sheet feed portion 24 (sheet feed belt 24*b*). At this time, the sheet feed portion 24 is performing the feeding operation (operation of circulating the sheet feed belt 24*b* in the direction A) of conveying the document D from upstream to downstream in the document conveyance path 22, and meanwhile, the separating roller 30 is performing the separating operation (operation of rotating in the direction B) of returning the document D from downstream to upstream in the document conveyance path 22. Thus, the document D on the lower side which contacts only the separating roller 30 does not advance in the document conveyance direction D1. For example, the document D on the lower side is to return from downstream to upstream (in a direction opposite to the document conveyance direction D1) in the document conveyance path 22, or the document D on the lower side is to stay at its present position. Therefore, when the predetermined time (predicted time required for the document D to advance the distance L between the first position P1 and the second position P2 in the document conveyance direction D1) has elapsed since the document D has been detected at the first position P1, neither of the documents D on the upper side and the lower side has reached the second position P2. That is, even when the predetermined time has elapsed since the document conveyance control portion 210 has detected that the document D has reached the first position P1, the document conveyance control portion 210 does not detect that the document D has reached the second position P2.

Thus, even in the case where great skew has not occurred, if overlap feed has occurred, the document D may not be detected at the second position P2 when the predetermined time has elapsed since the document D has been detected at the first position P1. Therefore, at this point of time, whether or not great skew has occurred cannot be detected accurately. That is, whether overlap feed has occurred or great skew has occurred cannot be determined by only the fact that the document D has not been detected at the second position P2 when the predetermined time has elapsed since the document D has been detected at the first position P1.

Therefore, in the present embodiment, even if the document D has not been detected at the second position P2 when the predetermined time has elapsed since the document D has been detected at the first position P1, the document conveyance operation is not stopped at this point of time. That is, the sheet feed portion 24 continues the feeding operation of conveying the document D from upstream to downstream in the document conveyance path 22 (continues circulation of the sheet feed belt 24*b* in the direction A). However, the separating roller 30 switches its operation from the separating operation of returning the document D from downstream to upstream in the document conveyance path 22, to a non-separating operation of conveying the document D from upstream to downstream in the document conveyance path 22 (switches the rotation direction from the direction B to the direction C).

Figure 13:
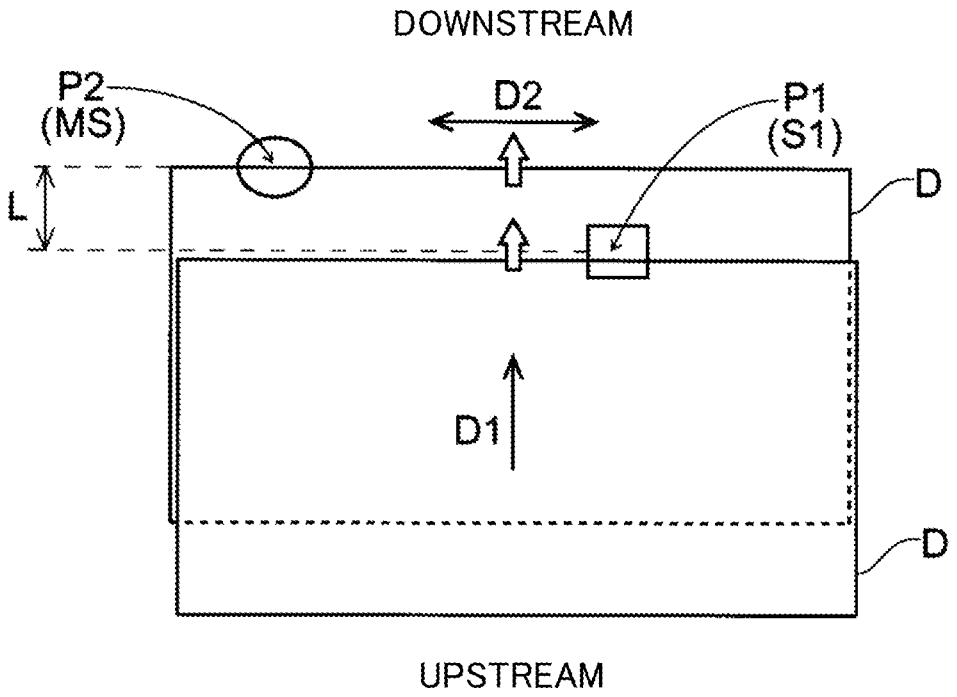
FIG. 13 is a schematic diagram for explaining the skew detection operation performed in the sheet conveyance device shown in FIG. 2 (in the case where overlap feed occurs).
Figure 14:
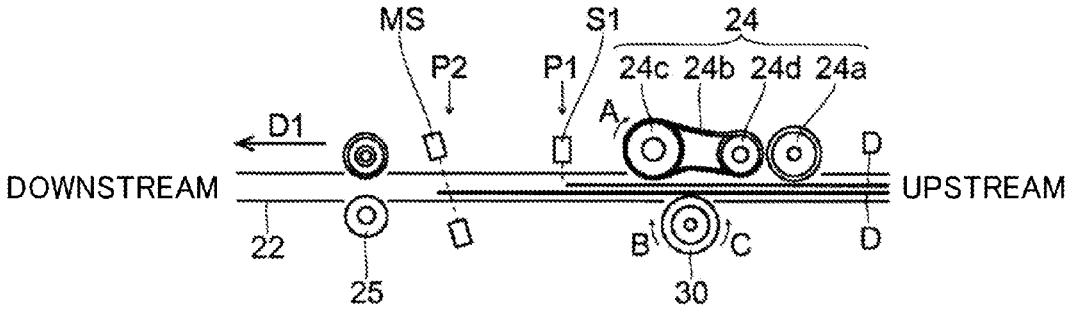
FIG. 14 is a schematic diagram for explaining the skew detection operation performed in the sheet conveyance device shown in FIG. 2 (in the case where overlap feed occurs).

When the separating roller 30 has started the non-separating operation, the document D on the lower side which contacts only the separating roller 30 advances in the document conveyance direction D1. At this time, since the sheet feed portion 24 is continuing the feeding operation, the document D on the upper side which contacts only the sheet feed portion 24 also advances in the document conveyance direction D1. Then, as shown in FIGS. 13 and 14, since the document D on the lower side precedes the document D on the upper side, the document D on the lower side reaches the second position P2 first.

Here, at the time when the separating roller 30 has started the non-separating operation, the leading end (the entire part including both parts on the one side and the other side in the direction D2) of the document D on the lower side has already reached downstream of the first position P1. Therefore, the document D on the lower side reaches the second position P2 by the time the predetermined time has elapsed since the separating roller 30 has started the non-separating operation. That is, the document conveyance control portion 210 detects that the document D has reached the second position P2, based on output of the multi feed detection sensor MS.

On the other hand, if the document D detected at the first position P1 has greatly skewed, as shown in FIG. 8, the output level of the multi feed detection sensor MS does not become a level indicating that the document D is present, by the time the predetermined time has elapsed since the separating roller 30 has started the non-separating operation. Therefore, the document conveyance control portion 210 does not detect that the document D has reached the second position P2.

Accordingly, in the present embodiment, whether or not the document D has reached the second position P2 by the time the predetermined time has elapsed since the separating roller 30 has started the non-separating operation, is detected, whereby whether or not skew has occurred is determined. That is, if the document D has not reached the second position P2 by the time the predetermined time has elapsed since the separating roller 30 has started the non-separating operation, this indicates that the state shown in FIG. 8 has occurred. Therefore, it is determined that skew has occurred and the document conveyance operation is stopped. On the other hand, if the document D has reached the second position P2 by the time the predetermined time has elapsed since the separating roller 30 has started the non-separating operation, this indicates that the state shown in FIGS. 13 and 14 has occurred. Therefore, it is determined that skew has not occurred and the document conveyance operation is continued.

If it is determined that skew has not occurred (the document conveyance operation is continued), the sheet feed portion 24 continues the feeding operation (continues circulation of the sheet feed belt 24*b* in the direction A). In addition, the separating roller 30 switches its operation from the non-separating operation to the separating operation (switches the rotation direction from the direction C to the direction B).

Figure 15:
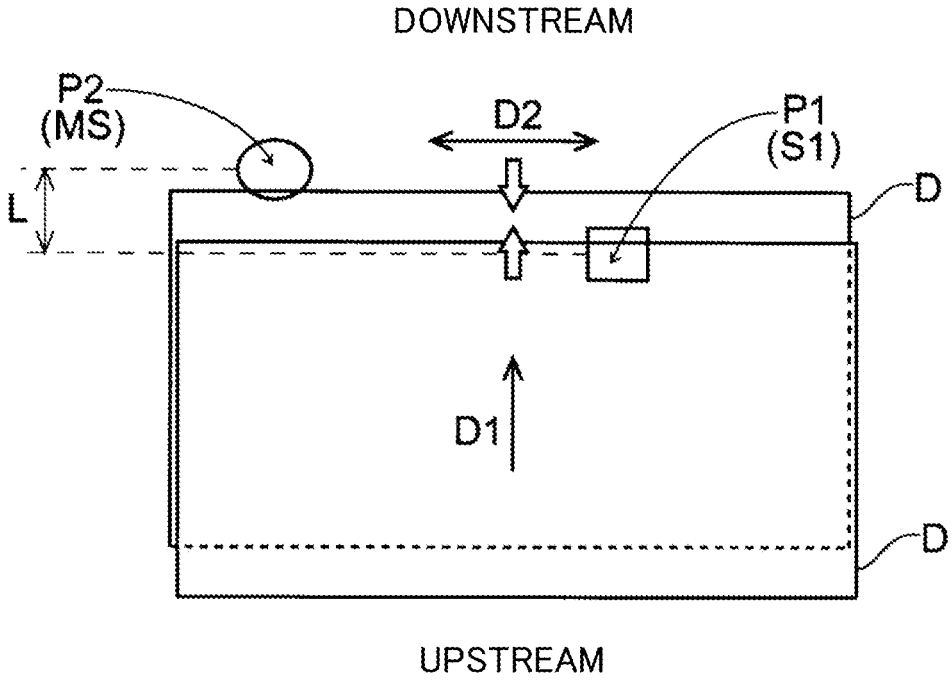
FIG. 15 is a schematic diagram for explaining the skew detection operation performed in the sheet conveyance device shown in FIG. 2 (in the case where overlap feed occurs).
Figure 16:
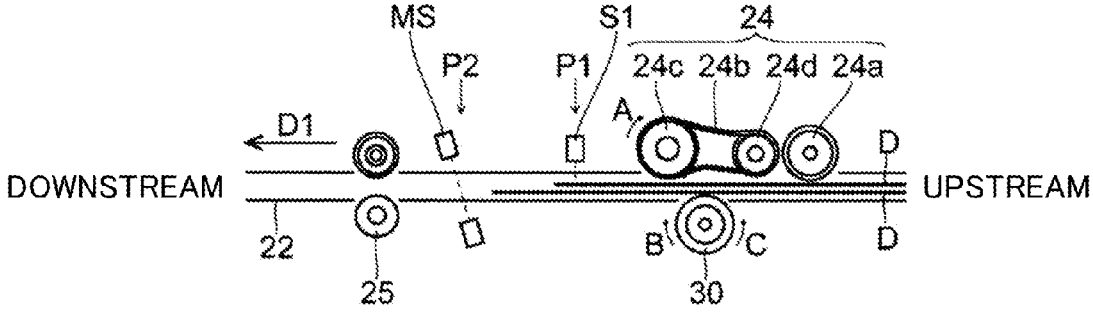
FIG. 16 is a schematic diagram for explaining the skew detection operation performed in the sheet conveyance device shown in FIG. 2 (in the case where overlap feed occurs).

Thus, as shown in FIGS. 15 and 16, the document D on the lower side which contacts only the separating roller 30 returns in a direction opposite to the document conveyance direction D1 or stays at its present position. Meanwhile, the document D on the upper side which contacts only the sheet feed portion 24 advances in the document conveyance direction D1. Therefore, by the document conveyance operation being continued in this state, the documents D on the upper side and the lower side are separated, so that the overlapping state is eliminated and only the document D on the upper side is conveyed. Thus, in the present embodiment, even if multi feed such as overlap feed has occurred, multi feed such as overlap feed is eliminated as time elapses.

Figure 17:
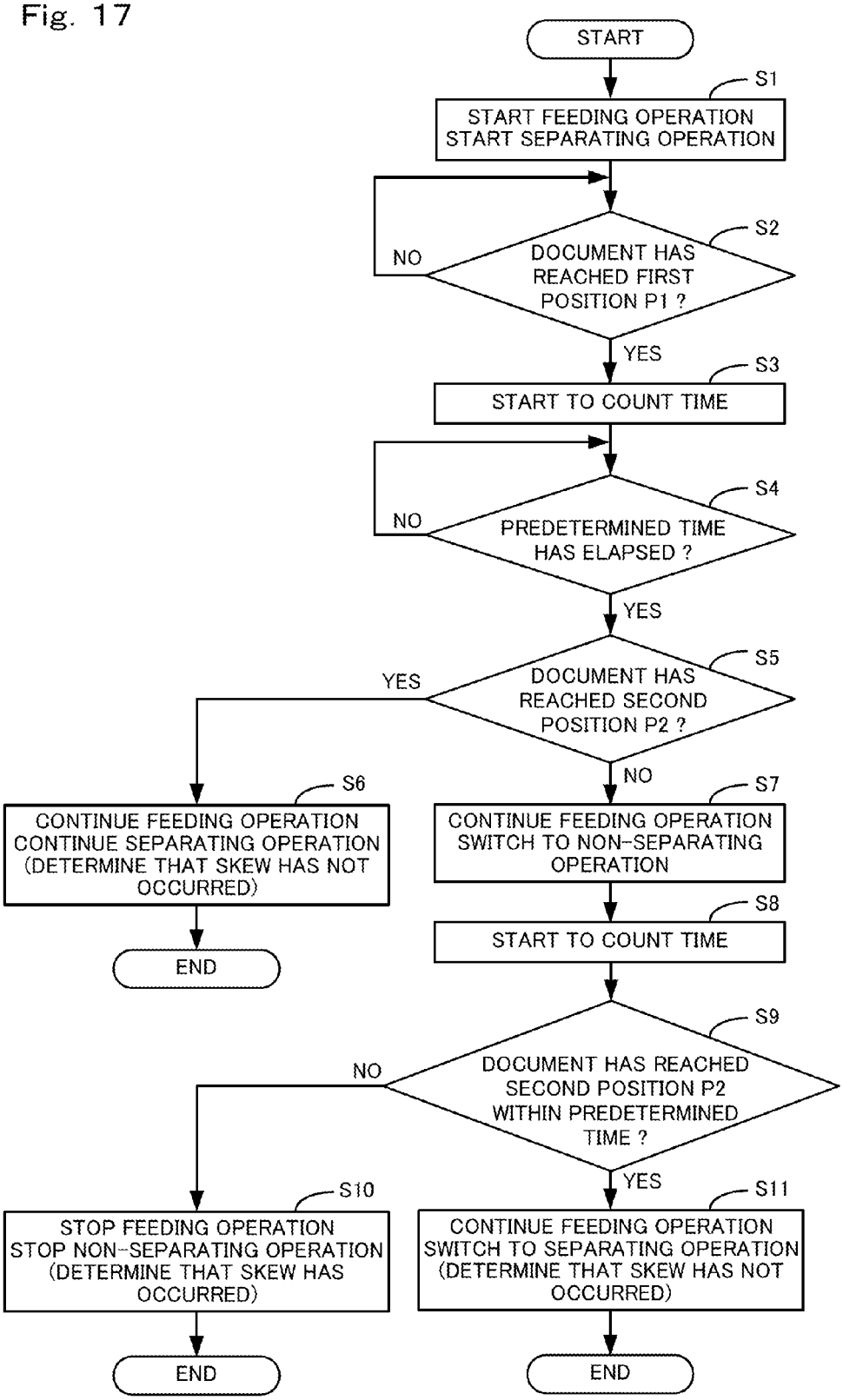
FIG. 17 is a flowchart for explaining a flow of the skew detection operation performed in the sheet conveyance device shown in FIG. 2.

Hereinafter, along a flowchart shown in FIG. 17, the flow of a skew detection operation in the document conveyance device 200 will be described. It is noted that "START" in the flowchart in FIG. 17 indicates the time when the document conveyance control portion 210 has received an instruction to start a document conveyance operation from the main control portion 110.

In step S1, the document conveyance control portion 210 starts to supply a document D from the document set tray 21 to the document conveyance path 22. That is, the document conveyance control portion 210 starts to drive the sheet feed motor M1 to rotate forward, thereby causing the sheet feed portion 24 to perform a feeding operation of conveying the document D from upstream to downstream in the document conveyance path 22, and also causing the separating roller 30 to perform a separating operation of returning the document D from downstream to upstream in the document conveyance path 22.

Then, in step S2, the document conveyance control portion 210 determines whether or not the document D has reached the first position P1 which is the detection position of the document detection sensor S1, based on output of the document detection sensor S1. As a result, if the document D has reached the first position P1, the process shifts to step S3. On the other hand, if the document D has not reached the first position P1, the determination in step S2 is repeated.

In step S3, the document conveyance control portion 210 starts to count time, to acquire a time that has elapsed since the document D has been detected at the first position P1. Then, in step S4, the document conveyance control portion 210 determines whether or not the predetermined time (predicted time required for the document D to advance the distance L between the first position P1 and the second position P2 in the document conveyance direction D1) has elapsed since the document D has been detected at the first position P1. As a result, if the predetermined time has elapsed, the process shifts to step S5. On the other hand, if the predetermined time has not elapsed, the determination in step S4 is repeated.

In step S5, the document conveyance control portion 210 determines whether or not the document D has reached the second position P2 which is the detection position of the multi feed detection sensor MS, based on output of the multi feed detection sensor MS. As a result, if the document D has reached the second position P2, the process shifts to step S6. On the other hand, if the document D has not reached the second position P2, the process shifts to step S7.

If the process has shifted from step S5 to step S6, the document conveyance control portion 210 determines that skew has not occurred. That is, the document conveyance control portion 210 continues the feeding operation and the separating operation.

If the process has shifted from step S5 to step S7, the document conveyance control portion 210 switches drive of the sheet feed motor M1 from forward rotation drive to reverse rotation drive. When the sheet feed motor M1 is driven to rotate reversely, the separating roller 30 rotates reversely (rotates in the same direction as the rotation direction of the sheet feed motor M1). Meanwhile, the reverse rotation drive of the sheet feed motor M1 is transmitted as a forward rotation driving force to the sheet feed roller 24*c* of the sheet feed portion 24. Therefore, the sheet feed roller 24*c* continues to rotate forward. Thus, the sheet feed portion 24 continues the feeding operation. In addition, the separating roller 30 switches its operation from the separating operation to a non-separating operation of conveying the document D from upstream to downstream in the document conveyance path 22.

Subsequently, in step S8, the document conveyance control portion 210 starts to count time, to acquire a time that has elapsed since the separating roller 30 has started the non-separating operation. Then, in step S9, based on output of the multi feed detection sensor MS, the document conveyance control portion 210 determines whether or not the document D has reached the second position P2 by the time the predetermined time (predicted time required for the document D to advance the distance L between the first position P1 and the second position P2 in the document conveyance direction D1) has elapsed since the non-separating operation has been started. As a result, if the document D has not reached the second position P2, the process shifts to step S10. On the other hand, if the document D has reached the second position P2, the process shifts to step S11.

If the process has shifted from step S9 to step S10, the document conveyance control portion 210 determines that skew has occurred. Then, the document conveyance control portion 210 stops driving the sheet feed motor M1. Thus, the sheet feed portion 24 and the separating roller 30 stop driving (the sheet feed portion 24 stops the feeding operation and the separating roller 30 stops the non-separating operation).

If the process has shifted from step S9 to step S11, the document conveyance control portion 210 determines that skew has not occurred. Then, the document conveyance control portion 210 switches the sheet feed motor M1 from reverse rotation drive to forward rotation drive. Thus, the sheet feed portion 24 continues the feeding operation. In addition, the separating roller 30 switches its operation from the non-separating operation to a separating operation.

Thus, in the configuration of the present embodiment, the separating roller 30 is disposed at a position opposing to the sheet feed portion 24 via the document conveyance path 22 (the sheet feed portion 24 is disposed on the upper side of the document conveyance path 22, and the separating roller 30 is disposed on the lower side of the document conveyance path 22), whereby the feed nip is formed by the sheet feed portion 24 and the separating roller 30. Therefore, for example, even if a document D on the upper side to be fed at the present is fed with delay from a document D on the lower side not to be fed at the present and thereby overlap feed has occurred in which the document D on the upper side is fed overlapping with the document D on the lower side, the overlap feed is eliminated. Specifically, in the case where overlap feed has occurred, when the succeeding document D on the upper side has reached the feed nip, the succeeding document D on the upper side enters between the preceding document D on the lower side and the sheet feed portion 24, so that the preceding document D on the lower side does not contact the sheet feed portion 24. Then, the document D on the lower side returns from its present position to upstream (or stays at its present position) by the separating operation by the separating roller 30. Meanwhile, the document D on the upper side is fed from its present position to downstream by the feeding operation by the sheet feed portion 24. Therefore, the sheets on the upper side and the lower side are separated, whereby overlapping state of the document D on the upper side and the document D on the lower side is eliminated.

In addition, in the case where overlap feed has occurred, the document D on the lower side may reach the first position P1 before the document D on the upper side reaches the feed nip. In this case, the document D on the lower side returns from its present position to upstream after the document D on the upper side has reached the feed nip. Therefore, when the predetermined time has elapsed since the document D has been detected at the first position P1, neither of the documents D on the upper side and the lower side has reached the second position P2. Therefore, when the predetermined time has elapsed since the document D has been detected at the first position P1, the document D has not been detected at the second position P2.

Here, for example, it will be assumed that skew (skew so great that the document D will jam) has occurred so that, of the document D, a part on one side (first position P1 side) in the direction D2 perpendicular to the document conveyance direction D1 precedes a part on the other side (second position P2 side). In this case, when the predetermined time has elapsed since the document D has been detected at the first position P1, the part on the other side of the document D has not reached the second position P2 because of the great skew of the document D. Therefore, when the predetermined time has elapsed since the document D has been detected at the first position P1, the document D has not been detected at the second position P2. This is the same situation as in the case where overlap feed has occurred. Therefore, if skew detection is performed when the predetermined time has elapsed since the document D has been detected at the first position P1, erroneous detection is likely to occur (occurrence of overlap feed is detected as occurrence of skew).

Therefore, in the configuration of the present embodiment, if the document D has not been detected at the second position P2 when the predetermined time has elapsed since the document D has been detected at the first position P1, the separating roller 30 switches its operation from a separating operation to a non-separating operation of conveying the document D from upstream to downstream in the document conveyance path 22, and meanwhile, the sheet feed portion 24 continues the feeding operation. Thus, in the case where overlap feed has occurred, the documents D are conveyed in an overlapping manner from upstream to downstream in the document conveyance path 22 in the state in which the document D on the lower side precedes the document D on the upper side. In the case where great skew has occurred, the document D is conveyed from upstream to downstream in the document conveyance path 22 in the state in which the part on the one side (first position P1 side) of the document D precedes the part on the other side (second position P2 side).

Thus, in the case where the reason why the document D has not been detected at the second position P2 when the predetermined time has elapsed since the document D has been detected at the first position P1 is due to occurrence of overlap feed (excluding the case where great skew has occurred), the document D on the lower side reaches the second position P2 and the document D is detected at the second position P2 by the time the predetermined time has elapsed since the separating roller 30 has started the non-separating operation. On the other hand, in the case where the reason why the document D has not been detected at the second position P2 when the predetermined time has elapsed since the document D has been detected at the first position P1 is due to occurrence of great skew, the part on the other side (second position P2 side) of the document D is delayed from the part on the one side (first position P1 side), and therefore the part on the other side of the document D does reach the second position P2 and the document D is not detected at the second position P2 by the time the predetermined time has elapsed since the separating roller 30 has started the non-separating operation.

Accordingly, in the configuration of the present embodiment, if the document D has not been detected at the second position P2 by the time the predetermined time has elapsed since the separating roller 30 has started the non-separating operation, the separating roller 30 and the sheet feed portion 24 stop driving. On the other hand, if the document D has been detected at the second position P2 by the time the predetermined time has elapsed since the separating roller 30 has started the non-separating operation, the separating roller 30 switches its operation from the non-separating operation to a separating operation, and meanwhile, the sheet feed portion 24 continues the feeding operation. Thus, the feeding operation can be prevented from being stopped even though great skew has not occurred, and therefore convenience for a user is improved.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance device comprising:

a sheet feed portion configured to perform a feeding operation of feeding a sheet placed on a set tray to a sheet conveyance path and conveying the sheet from upstream to downstream in the sheet conveyance path;

a separating portion disposed opposing to the sheet feed portion via the sheet conveyance path, and configured to perform a separating operation of returning a plurality of the sheets fed in an overlapping manner, from downstream to upstream in the sheet conveyance path, thereby separating one by one the sheets fed to the sheet conveyance path;

a conveyance portion disposed downstream of the sheet feed portion and configured to convey, downstream in the sheet conveyance path, the sheet conveyed from the sheet feed portion;

a first sensor configured to detect whether or not a sheet is present at a first position between the sheet feed portion and the conveyance portion;

a second sensor configured to detect whether or not the sheet is present at a second position between the sheet feed portion and the conveyance portion, the second position being located downstream of the first position in a sheet conveyance direction and being spaced from the first position in the sheet conveyance direction and in a direction intersecting the sheet conveyance direction; and a control portion, wherein in the case where the sheet has not been detected at the second position when a predetermined time has elapsed since the sheet has been detected at the first position, the control portion causes the separating portion to switch operation thereof from the separating operation to a non-separating operation of conveying the sheet from upstream to downstream in the sheet conveyance path, and causes the sheet feed portion to continue the feeding operation, and in the case where the sheet has not been detected at the second position by the time the predetermined time has elapsed since the separating portion has started the non-separating operation, the control portion causes the separating portion and the sheet feed portion to stop driving, and where the sheet has been detected at the second position by the time, the control portion causes the separating portion to switch operation thereof from the non-separating operation to the separating operation, and causes the sheet feed portion to continue the feeding operation.

2. The sheet conveyance device according to claim 1, wherein the predetermined time is a predicted time required for the sheet to advance a distance between the first position and the second position in the sheet conveyance direction.

3. The sheet conveyance device according to claim 1, wherein the second sensor is a sensor whose output level varies depending on whether or not the sheet is present at the second position and on a number of overlapping sheets.

4. The sheet conveyance device according to claim 1, wherein the conveyance portion is a registration portion which stops advance of the sheet from upstream to downstream in the sheet conveyance path once and then conveys the sheet from upstream to downstream in the sheet conveyance path.

5. A document conveyance device which conveys a document as a sheet, the document conveyance device comprising:

a sheet feed portion configured to perform a feeding operation of feeding a sheet placed on a set tray to a sheet conveyance path and conveying the sheet from upstream to downstream in the sheet conveyance path;

a separating portion disposed opposing to the sheet feed portion via the sheet conveyance path, and configured to perform a separating operation of returning a plurality of the sheets fed in an overlapping manner, from downstream to upstream in the sheet conveyance path, thereby separating one by one the sheets fed to the sheet conveyance path;

a conveyance portion disposed downstream of the sheet feed portion and configured to convey, downstream in the sheet conveyance path, the sheet conveyed from the sheet feed portion;

a first sensor configured to detect whether or not a sheet is present at a first position between the sheet feed portion and the conveyance portion;

a second sensor configured to detect whether or not the sheet is present at a second position between the sheet feed portion and the conveyance portion, the second position being located downstream of the first position in a sheet conveyance direction and being spaced from the first position in the sheet conveyance direction and in a direction intersecting the sheet conveyance direction; and a control portion, wherein in the case where the sheet has not been detected at the second position when a predetermined time has elapsed since the sheet has been detected at the first position, the control portion causes the separating portion to switch operation thereof from the separating operation to a non-separating operation of conveying the sheet from upstream to downstream in the sheet conveyance path, and causes the sheet feed portion to continue the feeding operation, and in the case where the sheet has not been detected at the second position by the time the predetermined time has elapsed since the separating portion has started the non-separating operation, the control portion causes the separating portion and the sheet feed portion to stop driving, and where the sheet has been detected at the second position by the time, the control portion causes the separating portion to switch operation thereof from the non-separating operation to the separating operation, and causes the sheet feed portion to continue the feeding operation.

6. The document conveyance device according to claim 5, wherein the predetermined time is a predicted time required for the sheet to advance a distance between the first position and the second position in the sheet conveyance direction.

7. The document conveyance device according to claim 5, wherein the second sensor is a sensor whose output level varies depending on whether or not the sheet is present at the second position and on a number of overlapping sheets.

8. The document conveyance device according to claim 5, wherein the conveyance portion is a registration portion which stops advance of the sheet from upstream to downstream in the sheet conveyance path once and then conveys the sheet from upstream to downstream in the sheet conveyance path.

9. An image forming apparatus comprising:

an image forming portion configured to form an image on a sheet; and the sheet conveyance device according to claim 1, configured to convey the sheet to the image forming portion.

10. The image forming apparatus according to claim 9, wherein the predetermined time is a predicted time required for the sheet to advance a distance between the first position and the second position in the sheet conveyance direction.

11. The image forming apparatus according to claim 9, wherein the second sensor is a sensor whose output level varies depending on whether or not the sheet is present at the second position and on a number of overlapping sheets.

12. The image forming apparatus according to claim 9, wherein the conveyance portion is a registration portion which stops advance of the sheet from upstream to downstream in the sheet conveyance path once and then conveys the sheet from upstream to downstream in the sheet conveyance path.

13. An image forming apparatus comprising:

an image reading portion configured to read a document image;

an image forming portion configured to form an image based on image data; and the document conveyance device according to claim 5, configured to convey a document as the sheet to the image forming portion.

14. The image forming apparatus according to claim 13, wherein the predetermined time is a predicted time required for the sheet to advance a distance between the first position and the second position in the sheet conveyance direction.

15. The image forming apparatus according to claim 13, wherein the second sensor is a sensor whose output level varies depending on whether or not the sheet is present at the second position and on a number of overlapping sheets.

16. The image forming apparatus according to claim 13, wherein the conveyance portion is a registration portion which stops advance of the sheet from upstream to downstream in the sheet conveyance path once and then conveys the sheet from upstream to downstream in the sheet conveyance path.

* * * * *